US006422477B2

(12) United States Patent
Hébert

(10) Patent No.: US 6,422,477 B2
(45) Date of Patent: Jul. 23, 2002

(54) HEAT RECOVERY REFLECTOR FOR BASEBOARD HEAT CONVECTOR

(76) Inventor: L. Paul Hébert, 15 The Lane at Stillwater Lake, Upper Tantallon, Nova Scotia (CA), B3Z 1H6

( * ) Notice: Subject to any disclaimer, the term of this patent is extended or adjusted under 35 U.S.C. 154(b) by 0 days.

(21) Appl. No.: 09/759,206

(22) Filed: Jan. 16, 2001

(30) Foreign Application Priority Data

Mar. 7, 2000 (CA) ..... 2302333

(51) Int. Cl.[7] ..... F24D 19/06
(52) U.S. Cl. ..... 237/79; 165/55
(58) Field of Search ..... 165/55; 237/79; 454/287, 246

(56) References Cited

U.S. PATENT DOCUMENTS

| | | | | |
|---|---|---|---|---|
| 2,014,117 A | | 9/1935 | Simoneau | 257/133 |
| 2,060,088 A | | 11/1936 | Lane | 237/79 |
| 2,855,185 A | | 10/1958 | Runte | 257/124 |
| 2,904,666 A | * | 9/1959 | Jackson | 237/79 |
| 3,356,829 A | * | 12/1967 | Brandenburg | 237/79 |
| 3,551,642 A | | 12/1970 | Knoll | 219/368 |
| 3,679,868 A | * | 7/1972 | England | 219/368 |
| 4,383,575 A | | 5/1983 | Bobrowski | 165/55 |
| 4,399,805 A | | 8/1983 | Kienlen et al. | 126/121 |
| 4,761,537 A | * | 8/1988 | Hayes | 219/366 |
| 5,416,283 A | * | 5/1995 | Dault et al. | 181/150 |
| 5,597,033 A | * | 1/1997 | Cali | 165/55 |

FOREIGN PATENT DOCUMENTS

| | | |
|---|---|---|
| CA | 567955 | 12/1958 |
| CA | 1090979 | 12/1980 |

* cited by examiner

*Primary Examiner*—Harold Joyce
*Assistant Examiner*—Derek S. Boles
(74) *Attorney, Agent, or Firm*—Mario Theriault

(57) ABSTRACT

The heat recovery reflector has a channel-like extrusion comprising a web and flanges bordering the web. The web has a heat reflective surface thereon and the flanges have a substantial depth relative to the thickness of the web. The distances between the flanges is similar to the height of the back surface of a baseboard heat convector. The channel-like extrusion is mountable behind a baseboard heat convector for defining with the back surface of the baseboard heat convector a closed space for maintaining the heat reflective surface in a dust free environment. In another aspect of the invention, each flange has serrations of the inside surface thereof. A pair of caps is provided for covering the ends of the channel-like extrusion. Each cap has tabs extending therefrom and each of the tabs has at least one notch which is engagedly mountable in one of the serrations on the flanges.

20 Claims, 9 Drawing Sheets

(3 of 9 Drawing Sheet(s) Filed in Color)

HEAT RECOVERY REFLECTOR FOR BASEBOARD HEAT CONVECTOR

FIELD OF THE INVENTION

This invention relates to heat reflectors, and more particularly it pertains to a reflector mountable behind a baseboard type heat convector for recovering heat conducted through the back structure of the heater.

BACKGROUND OF THE INVENTION

In the early 1960's, the construction industry has witnessed a substantial increase in installations of electric baseboard convectors. It is believed that the rising cost of labor, generally, and the low cost of electricity have contributed to make of the electric baseboard convectors a reasonably low cost system for space heating. This system was also particularly appealing to the construction industry for its easy installation, and it was quickly adopted for the residential market especially. As the construction costs increased during the 1970's and 1980's, this type of heating system remained an attractive option.

A conventional electric baseboard heat convector contains a finned electrical element mounted longitudinally inside a sheet metal housing. The heat generated by the element causes the air to rise and to naturally circulate inside the heater. A heat transfer occurs between the circulated air and the finned heating element of the heater. Heat energy is absorbed by the air circulated inside the heater and is transmitted by natural convection to the ambient air inside the room in which the heater is installed, for heating the room. A modem version of a baseboard heat convector of the common type is described in U.S. Pat. No. 3,551,642, issued on Dec. 29, 1970 to David Knoll. The terms baseboard heat convector, baseboard heater, heat convector and heater are used interchangeably herein for convenience, to designate generally, the type of heater which is described in the above reference.

It is known that a portion of the heat energy generated by these baseboard heaters is radiated toward the back portion of the metal housing and is transmitted by conduction to the wall on which the heater is mounted. This conducted heat is lost through the wall and to the outside of the building.

Numerous attempts have been made in the past by manufacturers and utility companies to increase the efficiency of electric baseboard heating systems in an effort to save energy, and obviously to help consumers to save on heating costs. For many years, utility companies and energy saving consultants have encouraged consumers to add insulation to existing buildings, to use higher insulation standards in new buildings, to seal off air infiltrations, to use energy efficient windows, etcetera. These are considered to be good design practices, but in a certain aspect, are only corrective measures and do not address the loss of heat radiated and conducted through the wall on which a heat convector is mounted.

Although it is believed that the construction industry does not abound with practical solutions to recover the heat losses from behind baseboard heat convectors, the patent literature contains some suggestions to at least partly resolve this problem, depending on the circumstances. It is known that the prior art describes a number of heat reflectors which are usable for reducing the radiation and conduction of heat through the back structure of various types of heat convectors. Some of these devices are described in the following patent documents:

U.S. Pat. No. 2,014,117, issued on Sep. 10, 1935 to C. B. Simoneau;

U.S. Pat. No. 2,060,088, issued on Nov. 10, 1936 to A. M. Lane;

U.S. Pat. No. 2,855,185, issued on Oct. 7, 1958 to E. Runte;

U.S. Pat. No. 4,383,575, issued on May 17, 1983 to L. G. Bobrowski;

U.S. Pat. No. 4,399,805, issued on Aug. 23, 1983 to L. C. Kienlen et al.;

CA Patent 567,955, issued on Dec. 23, 1958 to T. W. Glynn;

CA Patent 1,090,979, issued on Dec. 9, 1980 to L. Nowicki.

A common drawback with the reflectors of the prior art, however, is that the space between the heating element and the reflective surface is exposed to the ambient air. The dust carried by the air stream passing between the heating element and the reflective surface deposits on the reflective surface and causes the reflector to quickly lose its properties. The cleaning of these reflectors is not always easy and therefore these heat reflectors are not always efficient and esthetical.

The prior art is also short on suggestions with regard to a reflector which can be installed to the back of a common wall-mounted baseboard heater without changing the appearance of the baseboard heater, without overly changing the projection of the heater from the wall on which it is mounted, and without reducing the structural strength of the attachment of the heater to the wall.

As such, it may be appreciated that there continues to be a need for a new and improved reflector that may be readily mounted behind a baseboard heat convector for recovering the heat lost through the wall behind the heater, and for improving the efficiency of the baseboard beater. It is believed that there continues to be a need for a heat recovery reflector which can be used as a retrofit unit to be mounted behind an existing baseboard heater or as a standard accessory usable in all new baseboard heater installations.

SUMMARY OF THE INVENTION

In the present invention, however, there is provided a heat recovery reflector which is mountable behind a baseboard heat convector for reflecting radiated heat back onto the metal enclosure of the baseboard heat convector, for increasing the efficiency of the baseboard heat convector. The heat recovery reflector according to the present invention is easily mountable behind an existing baseboard heater or installed as an optional accessory behind a new baseboard heater. The heat recovery reflector is saleable in a kit form, wherein the longitudinal portion thereof is cuttable to various lengths to accommodate various sizes of baseboard heaters.

In a first aspect of the present invention, the heat recovery reflector comprises a channel-like extrusion having a web, a heat reflective surface on the web and flanges bordering the web and the heat reflective surface. The flanges have a substantial depth relative to the thickness of the web. The distance between the flanges is equal to or slightly less that the height of the back surface of a baseboard heat convector. This channel-like extrusion is mountable behind a baseboard heat convector for defining with the back surface of the heat convector, a closed space behind the heat convector. Consequently, as the heat reflective surface is totally enclosed, it does not collect dust and lose efficiency, as the prior art reflectors do if not cleaned periodically.

In an actual installation, the heat recovery reflector is mounted between a baseboard heater and a wall, for reflecting forwardly the heat conducted through the back portion of the heater housing. The principal advantage of this installation is that the heat transmitted through the back surface of the baseboard heater is radiated back to the back surface where it becomes available to raise the temperature of the air circulated inside the heater. The efficiency of the baseboard heater is thereby substantially increased.

In another aspect of the present invention, the thickness of the channel-like extrusion is about ¾ of an inch whereby the heat recovery reflector does not substantially change the projection of the baseboard heater from the wall on which it is mounted, and does not overly affect the structural strength of the attachment of the heater to the wall.

In yet another aspect of the present invention, there is provided a reflector kit for installation behind a baseboard heat convector. The reflector kit comprises a channel-like extrusion having a definite length and wherein each of the flanges has an inside surface relative to the web, and serrations on this inside surface. There is also provided a pair of caps for covering the ends of the channel-like extrusion. Each cap has tabs extending therefrom and each of the tabs has at least one notch thereon which is engagedly mountable in one of the serrations on the flanges. The channel-like extrusion is thereby cuttable to various lengths and the caps are mountable onto the ends of the trimmed length thereof.

Still another feature of the present heat recovery reflector is that it is susceptible of a low cost of manufacture with regard to both materials and labor, and which accordingly is then susceptible of low prices of sale to the consumer, thereby making such heat recovery reflector economically available to the public.

BRIEF DESCRIPTION OF THE DRAWINGS

The file of this patent contains at least one drawing executed in color. Copies of this patent with color drawing (s) will be provided by the Patent and Trademark Office upon request and payment of the neccessary fee.

DETAILED DESCRIPTION OF THE PREFERRED EMBODIMENT

Figure 1:
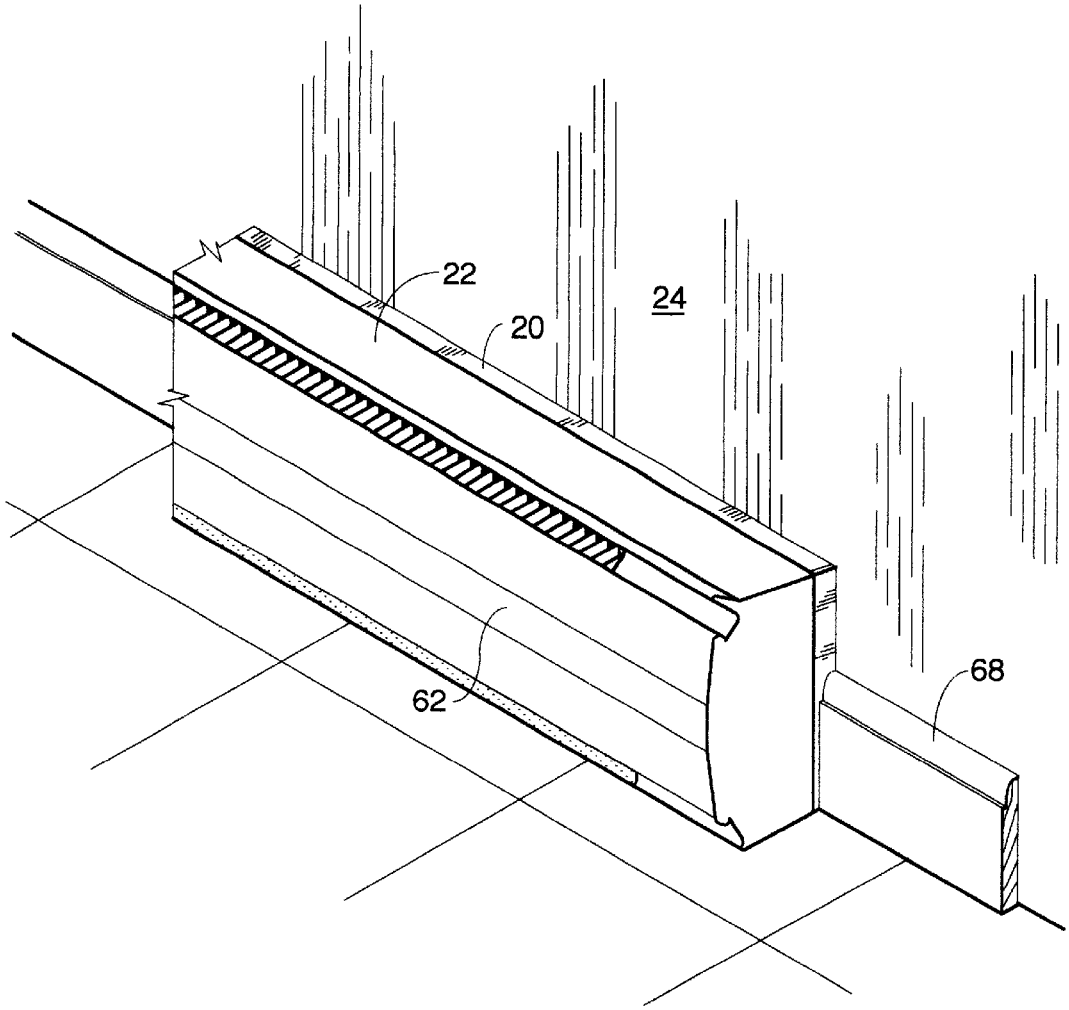
FIG. 1 is a partial isometric view of a baseboard heat convector and the heat recovery reflector according to the preferred embodiment of the present invention mounted behind the baseboard heat convector.
Figure 2:
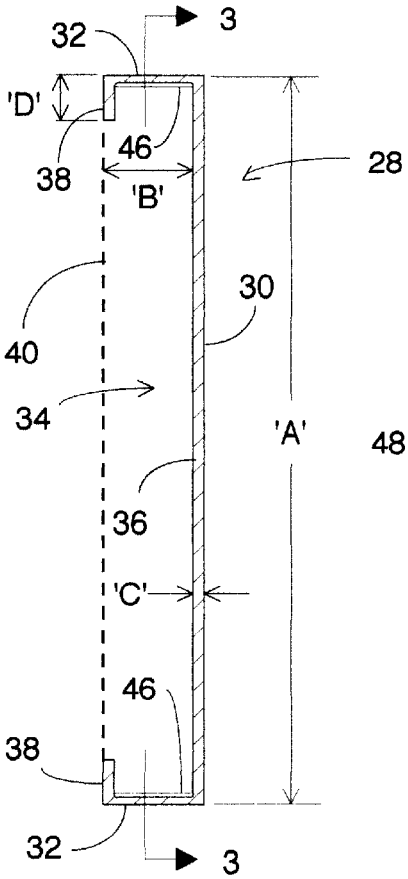
FIG. 2 is a cross-section view through the channel-like extrusion of the heat recovery reflector.
Figure 3:
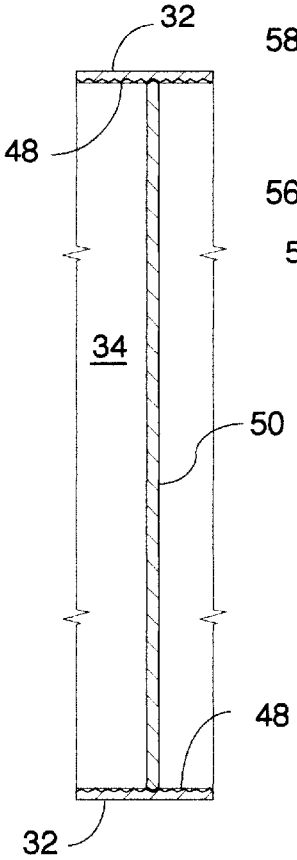
FIG. 3 is a partial cross-section view of the channel-like extrusion, as seen substantially along line 3—3 in FIG. 2 and looking at an intermediate segment of the back wall of the extrusion whilst looking through a movable stiffening blade mounted across the flanges of the extrusion.

While this invention is susceptible of embodiments in many different forms, there is shown in the drawings and will be described in details herein a specific embodiment, with the understanding that the present disclosure is to be considered as an example of the principles of the invention and is not intended to limit the invention to the embodiment illustrated and described.

Referring to FIG. 1, the heat recovery reflector 20 according to the preferred embodiment has width and height dimensions that are similar to the width and height of a conventional baseboard heater 22, such that the heat recovery reflector 20 is readily mountable between the baseboard heater 22 and the wall 24 on which the baseboard heater is installed, and does not project beside or above the housing of the baseboard heater. It is believed that a mounting of the heat recovery reflector 20 flush with the edges of the baseboard heater 22 is more esthetically acceptable.

With reference to FIGS. 2–10, the structural details of the heat recovery reflector will be explained. The heat recovery reflector 20 has a channel-like configuration 28 comprising a web 30 and flanges 32 adjoining the web 30 at right angle. The web and flanges are integrally formed by extrusion from a plastic material that is heat resistant, nonflammable and non-conductive. One of the preferred plastic materials is a medium density polyethylene of the thermoplastic family. Other preferred materials include PVC and styrene. The inside surface 34 of the web is covered by a heat reflective material 36. The preferred heat reflective material has a heat reflective index of between about 85% and 95% or better. The outside surfaces of the flanges 32 have a surface finish that is readily paintable.

Figure 9:
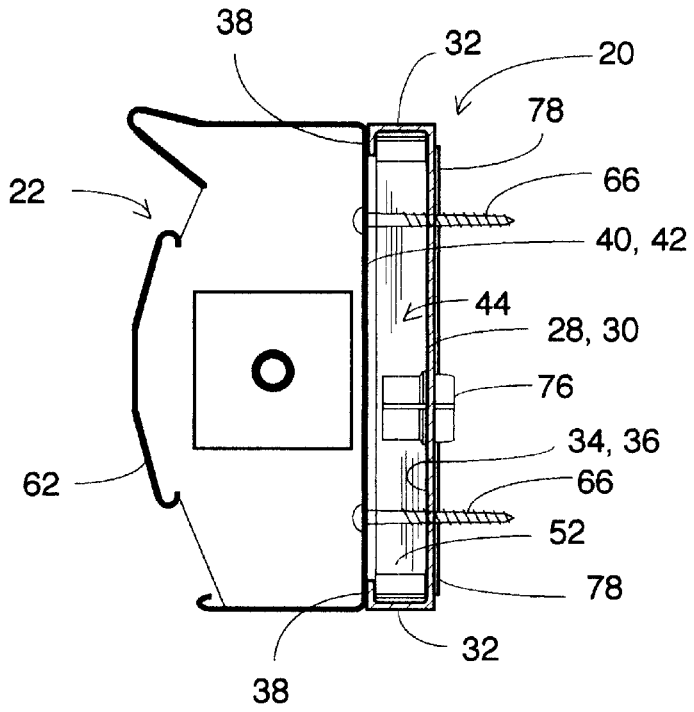
FIG. 9 is a cross-section view through the heat recovery reflector mounted behind a baseboard heat convector.

The channel-like extrusion 28, referred to herein as the extrusion or the channel extrusion, is manufactured in different heights 'A', with the other dimensions remaining substantially the same. The height 'A' of the web varies to accommodate the height of the baseboard heater behind which the reflector will be mounted. The depth 'B' of the channel extrusion 28 is preferably about ¾ of an inch. From experience, this depth dimension is believed to be ideal to provide a maximum efficiency of the reflector. The thickness 'C' of the web 30 and flanges 32 is preferably about 3/32 of an inch, but could be slightly more if desired. Lips 38 may be provided on the flanges 32. The height 'D' of these lips is preferably about 3/8 of an inch. Both lips 38 define a plane 40 which is mountable against the back planar surface 42 of a heat convector as can be seen in FIG. 9. Both lips 38 provide a good contact surface between a heat convector 22 and the heat recovery reflector 20. Both lips 38 provide a dust seal between the heat recovery reflector 20 and the back wall 42 of the baseboard heat convector 22. The inside surface 34, the back wall 42 of the heat convector and the flanges 32 define a closed space 44 which maintains the heat reflective surface 36 in a dust free environment.

The entire inside surfaces 46 of the flanges 32 are serrated surfaces, with saw-tooth-like serrations 48 extending at right angle with the longitudinal axis of the channel extrusion 28. The serrations 48 are preferably formed by gear-like grooved wheels (not shown) mounted next to the extrusion die from which the channel extrusion 28 is extruded, for working the plastic material in a soft condition. Other methods for forming the serrations 48 are also known to those skilled in the art. The serrations 48 are advantageous for retaining one or more stiffening blades 50 which may be installed at intervals inside the channel extrusion 28, to prevent sagging of the flanges for example. The serrations 48 are also advantageous for retaining end caps 52, for closing the ends of a channel extrusion 28, regardless of the length at which the extrusion is trimmed. The heat recovery reflector 20 can thereby be sold in a kit containing a channel extrusion 28 and a pair of end caps 52. The channel extrusion 28 may be trimmed to any length and installed by the customer. The end caps 52 are mountable to the trimmed length of the channel extrusion 28.

Each end cap 52 comprises a strip 54 which has the same width 'E' as the entire depth of the flanges 32 of the channel extrusion 28, which is about 27/32 of an inch. The end cap 52 also has a tab 56 extending at each end thereof. The strip 54 and the tabs 56 are preferably made of a same plastic material. The outside surface of the strip 54 also has a surface finish that it is readily paintable. The width 'F' of each tab 56 is about the same as the inside depth of the flange 32. The width 'F' of each tab 56 is about 21/32 of an inch or slightly less. The end of each tab 56 has one or more notches 58 which are adapted to engage with the serrations 48 on the flanges 32 for retaining the cap 52 to the end of the channel extrusion 28. For that purpose, the tabs 56 or the strip 54, or both the tabs and the strip are somewhat flexible to allow for a snap latching installation of the cap 52 to the end of the channel extrusion 28.

Figure 7:
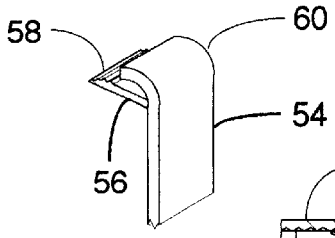
FIG. 7 is a partial isometric view of the alternate end cap.
Figure 6:
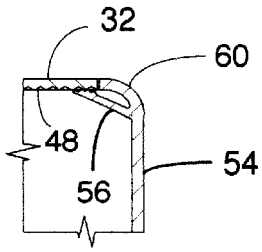
FIG. 6 is a partial cross-section view of an alternate end cap usable for closing an end on the channel-like extrusion.
Figure 5:
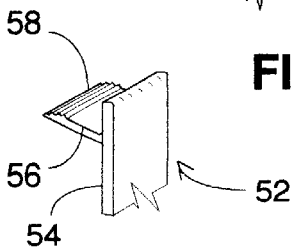
FIG. 5 is a partial isometric view of an end cap usable for closing an end on the channel-like extrusion.
Figure 4:
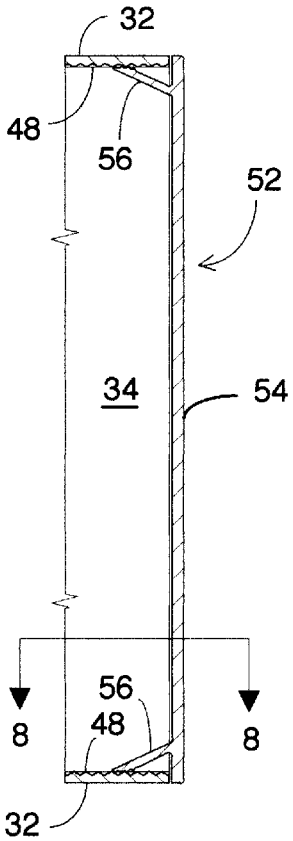
FIG. 4 is a partial cross-section view of the channel-like extrusion, as seen substantially along line 3—3 in FIG. 2 but looking at an end segment of the back wall of the extrusion, whilst looking through an end cap.
Figure 8:
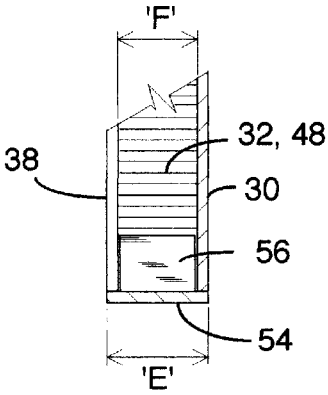
FIG. 8 is a partial cross-section view of the end cap mounted on the channel-like extrusion, as seen along line 8—8 in FIG. 4.

Referring particularly to FIGS. 6 and 7, the strip 54 of an end cap 52 may have a rounded top edge 60 such that a heat recovery reflector having the end caps with such a feature are more adaptable to some round-edge heat convectors, are more visually appealing and are less susceptible of hurting young infants playing around the heat recovery reflector.

Figure 10:
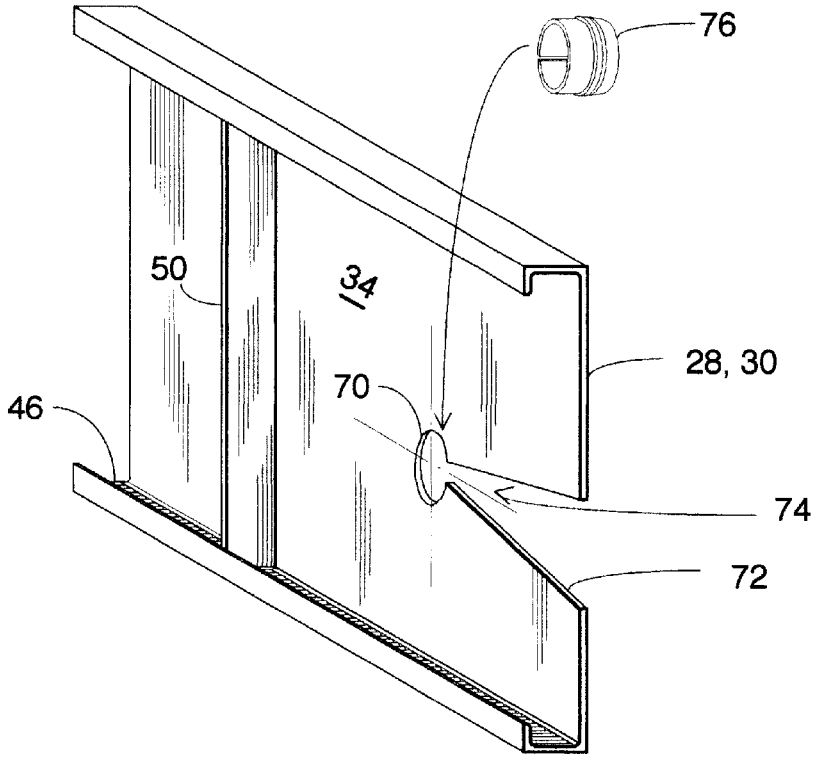
FIG. 10 is a partial isometric view of the channel-like extrusion.

With reference to FIGS. 9 and 10, a detailed retrofit installation procedure of the heat recovery reflector 20 behind an existing heat convector 22 is provided herein below. The channel extrusion 28 is preferably cut to length during the manufacturing thereof, to match one of many standard lengths of commercial baseboard heaters, plus about one inch. This extra inch may be trimmed on site after precisely measuring the heat convector 22 behind which the heat recovery reflector 20 will be installed, allowing for the thickness of the end caps 52.

During the retrofit installation of the heat recovery reflector 20, the electrical breaker connected to the heat convector 22 must be turned off. The positions of the top corners of the heat convector 22 are marked on the adjacent wall using masking tape for example. The front cover 62 of the heat convector is removed to expose the screws holding the heater to the wall. The locations of the holding screws are marked on the inside of the back wall of the metal housing of the heat convector 22 using a felt-tip pen for example. The holding screws can be removed, and the baseboard heater 22 may be pulled a few inches away from the wall. New screws 66 are then obtained in preparation for the reinstallation of the heater 22. The new screws 66 should have the same size as the original holding screws, but should be about one inch longer than the original screws.

It will be appreciated that the marking of the position of the baseboard heater 22 on the mounting wall may not be required if a wall base molding 68, as shown in FIG. 1, is present and indicates the exact location of the baseboard heater.

With the baseboard heater 22 pulled away from the wall, the entry point of the electrical cable through the back wall 40 of the heater 22 can be located. This location is transferred by measurement and felt-tip pen markings, to the inside surface 34 of the channel extrusion 28. Using a hole drill bit, a 7/8 inch hole 70 is made through the web 30 of the channel extrusion 28.

If Loomex™ type electrical cable is feeding this baseboard heater 22, there is no need to disconnect the cable from the heater. A V-shaped notch 72 is cut from the end of the channel extrusion 28 to the 7/8 inch hole 70, leaving a gap 74 of about one quarter of an inch wide at the circumference of the 7/8 inch hole 70. If BX™ armored cable is feeding this baseboard heater 22, the armored cable should be disconnected for installation of the heat recovery reflector 20.

After the channel extrusion 28 has been trimmed to the proper length, the channel extrusion 28 is placed behind the heater 22, and the Loomex™ cable is slid inside the V-shaped notch 72 and into the 7/8 inch hole 70, or the BX™ armored cable is pulled through the 7/8 inch hole 70, as the case may be. In the case of a BX™ armored cable, the cable is held to the channel extrusion 28, using a conventional metal connector. In the case of the Loomex™ cable, a non-metallic connector 76 is placed over the cable and is snapped in the 7/8 inch hole 70. The end caps 52 can then be installed on the ends of the channel extrusion 28. In order to prevent any separation of the end cap 52 from the extrusion 28, a drop of a suitable glue should be placed on the notch 58, at least on the top edge of the end cap 52, prior to mounting the end cap 52 onto the end of the extrusion 28.

A piece of double-sided carpet tape 78 is placed vertically on the back surface of the channel extrusion 28, at each end of the extrusion. The channel extrusion 28 is then aligned with the wall base molding 68, or with the masking tape indicators which were previously affixed to the wall behind the heat convector 22, and the extrusion 28 is pressed firmly against the wall until it holds well in place.

The heat convector 22 is then positioned over the heat recovery reflector 20, and holes are drilled through the web 30 of the channel extrusion 28 to match the locations of the original holding screws. Using the longer screws 66, the heat convector 22 is re-installed at its original position, thereby clamping the heat recovery reflector 20 against the wall.

It will be appreciated that the procedure for installing a heat recovery reflector 20 in a new building will be somewhat similar to the above-described retrofit installation procedure and therefore a detailed installation method for a new construction is not provided herein.

Figure 11:
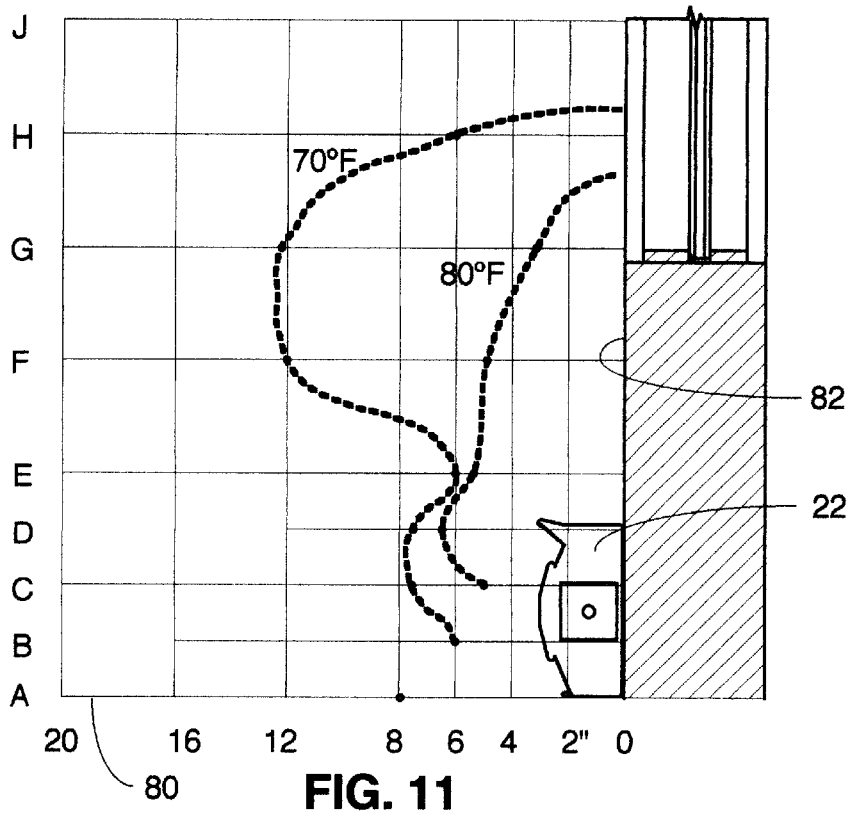
FIG. 11 is a first graph showing a typical temperature distribution of the air at the front of a conventional baseboard heat convector.
Figure 12:
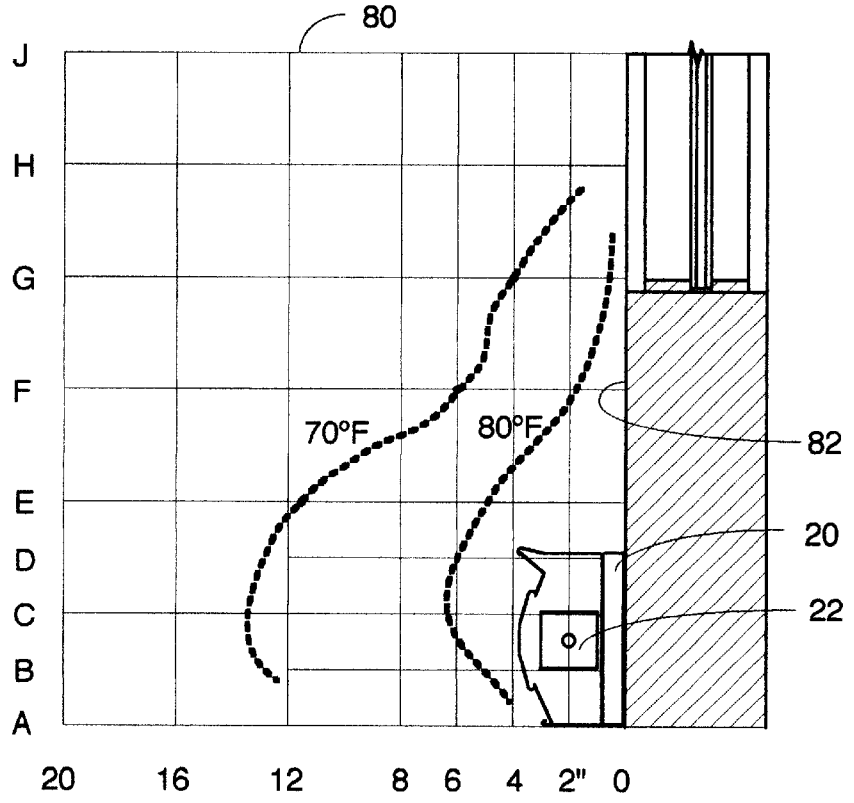
FIG. 12 is a second graph showing the temperature of the air at the front of a conventional baseboard heat convector having the heat recovery reflector mounted there behind.

A prototype of the heat recovery reflector according to the preferred embodiment was used to carry out some tests to determine the effect of the heat recovery reflector 20 in an actual installation. As illustrated in FIGS. 11 and 12, a cardboard template 80 measuring 20 inches by 26 inches with the profile of baseboard heater 22 cut out from the bottom corner thereof was installed perpendicularly to the wall 82 over a heat convector 22. Temperature readings at various locations on the cardboard template 80 were recorded on a corresponding graph sheet. Curves showing the 70° F. and 80° F. temperature boundaries were drawn up on the graph sheet, along the corresponding recorded readings. The FIG. 11 shows both the 70° F. and 80° F. temperature curves before the prototype heat recovery reflector was installed. The FIG. 12 shows both curves after the prototype heat recovery reflector 20 was installed. The 80° F. temperature curve in both FIGS. 11 and 12 is closest to the heat convector 22. The readings in FIGS. 11 and 12 were taken in a same afternoon with the same thermostat setting and substantially the same outside temperature. It will be appreciated from these illustrations that a substantial amount of heat was recovered by the prototype heat recovery reflector and reflected back to the heat convector 22 to improve on the efficiency of the heat convector.

Figure 13:
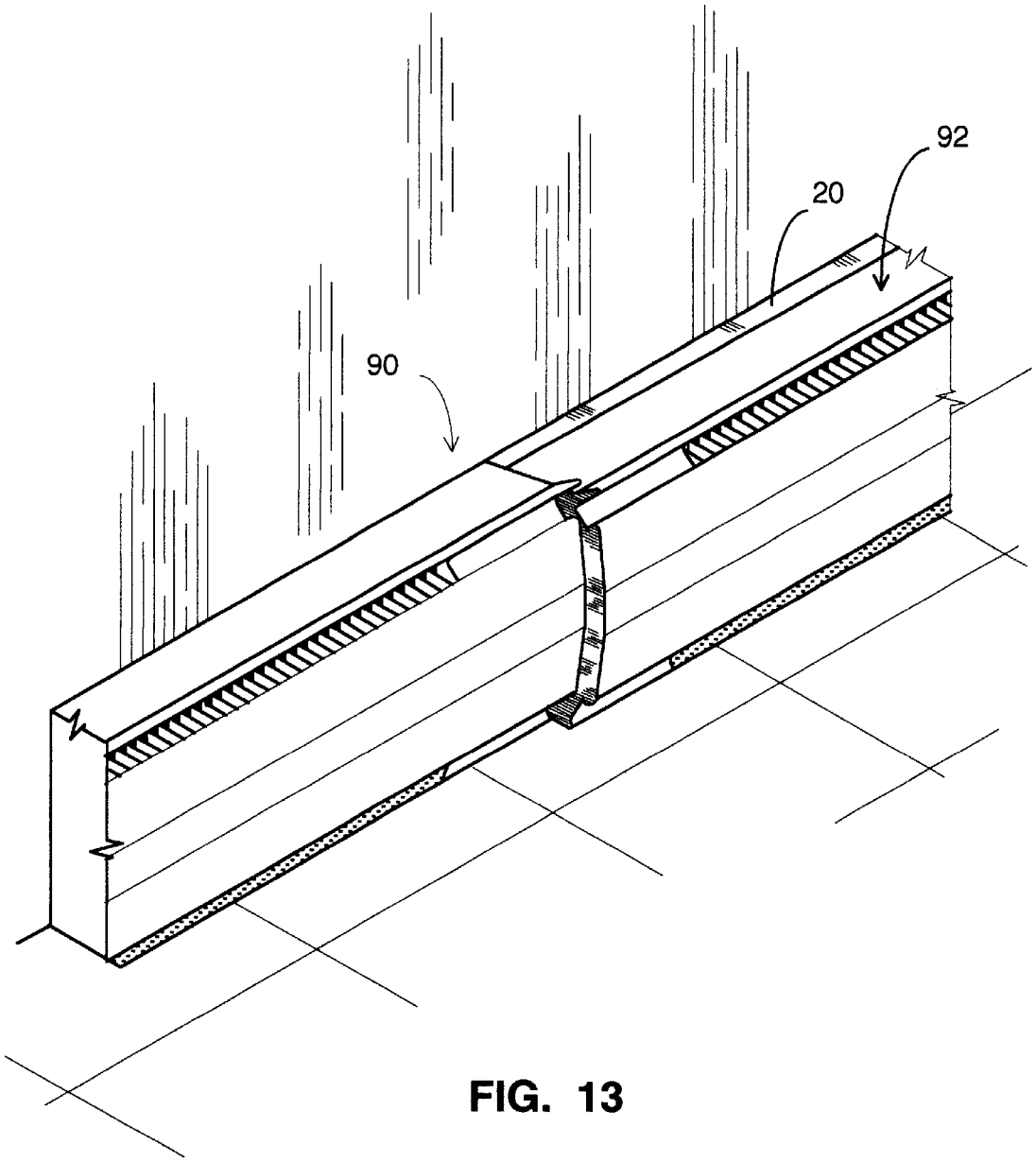
FIG. 13 is an isometric view of a test installation used for monitoring, by thermography, the increase in efficiency of the heat convector having a heat recovery reflector mounted there behind.
Figure 14:
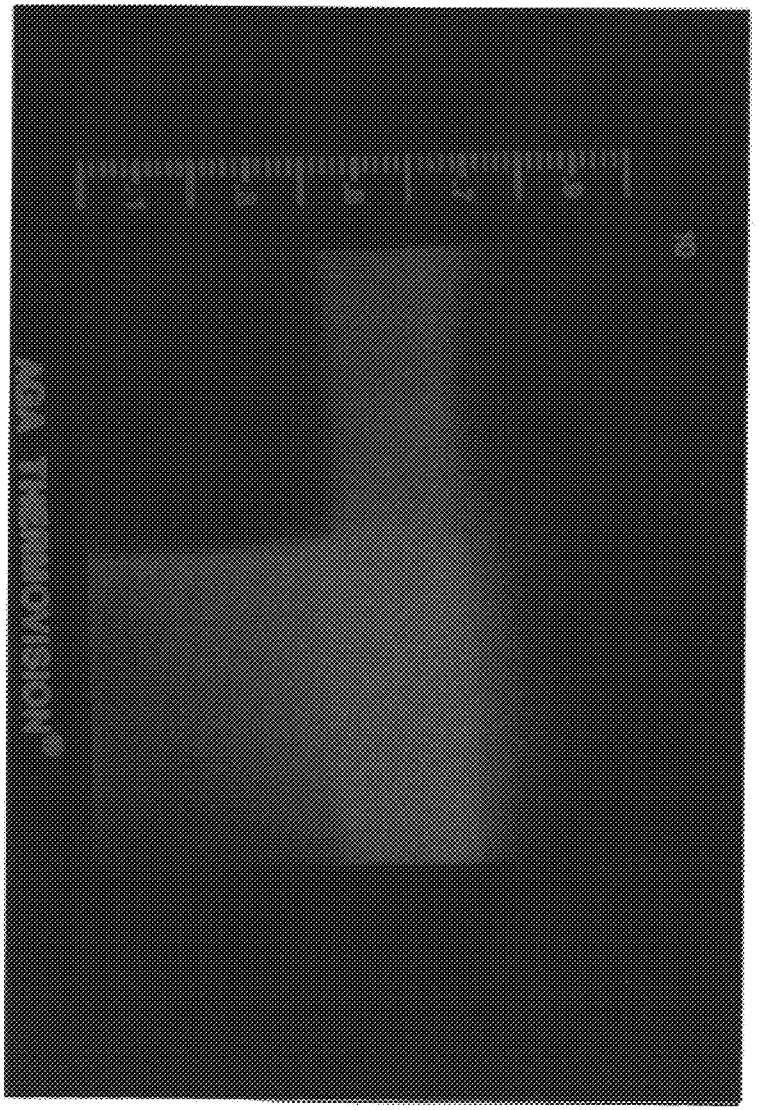
FIG. 14 is a basic thermographic image of the test installation.

Referring now to FIG. 13, there is illustrated therein a pair of baseboard heaters mounted end to end. The baseboard heater 90 on the left side is a conventional installation, and the baseboard heater 92 on the right side is mounted over a heat recovery reflector 20 according to the preferred embodiment. During a same night, a series of thermographic scans were made of the joining portions of the two heaters to determine the improvement in efficiency which is attributable to the heat recovery reflector 20. During this exercise, the inside temperature was 22° C. and the outside temperature was −13° C. Tests were carried out over three temperature settings, these are 5, 10 and 20 unit. However, no temperature reading was measured at the 10 unit range. This scan, as shown in FIG. 14, was used as a basic image for display only.

Figure 15:
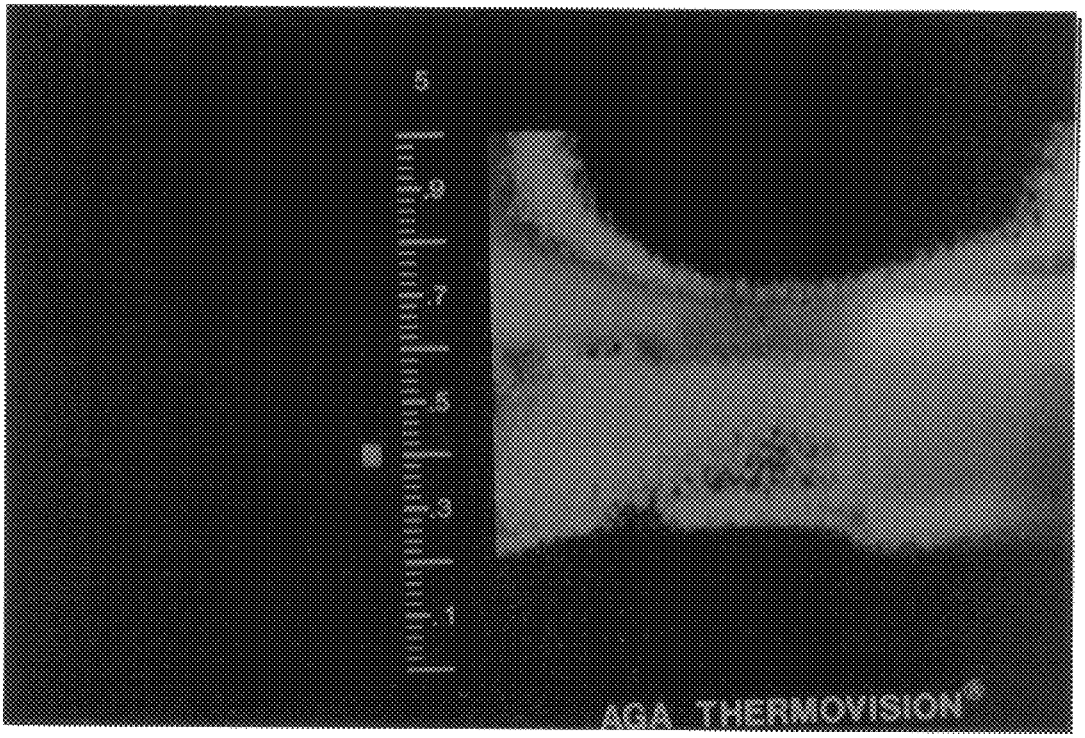
FIGS. 15 and 16 are first and second thermographic images of the test installation seen at a camera setting of 5 unit.
Figure 16:
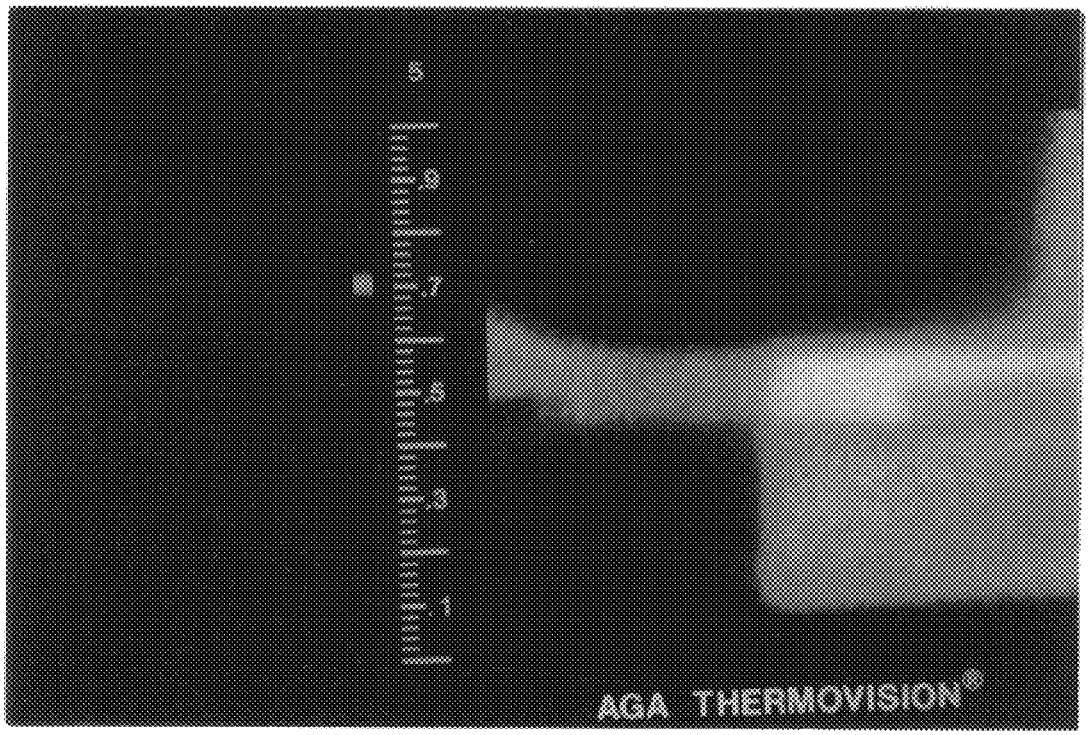

Referring now to FIGS. 15 and 16, the scale on the left side of the thermogram denotes points of equal temperature as shown by the white dots in the body of the image. These dots are called isotherms. The difference in the isotherms observed between the two heaters 90, 92 and the room temperature is used to calculate the temperature of the two heaters in relation to each other using room temperature as the standard. At the temperature range of 5 unit, the left baseboard heater 90 had an isotherm reading of 0.4 and the right baseboard heater 92 had a reading of 0.7. These readings indicate a temperature difference of 2° C. between the two baseboard heaters 90 and 92, the right one being higher.

Figure 17:
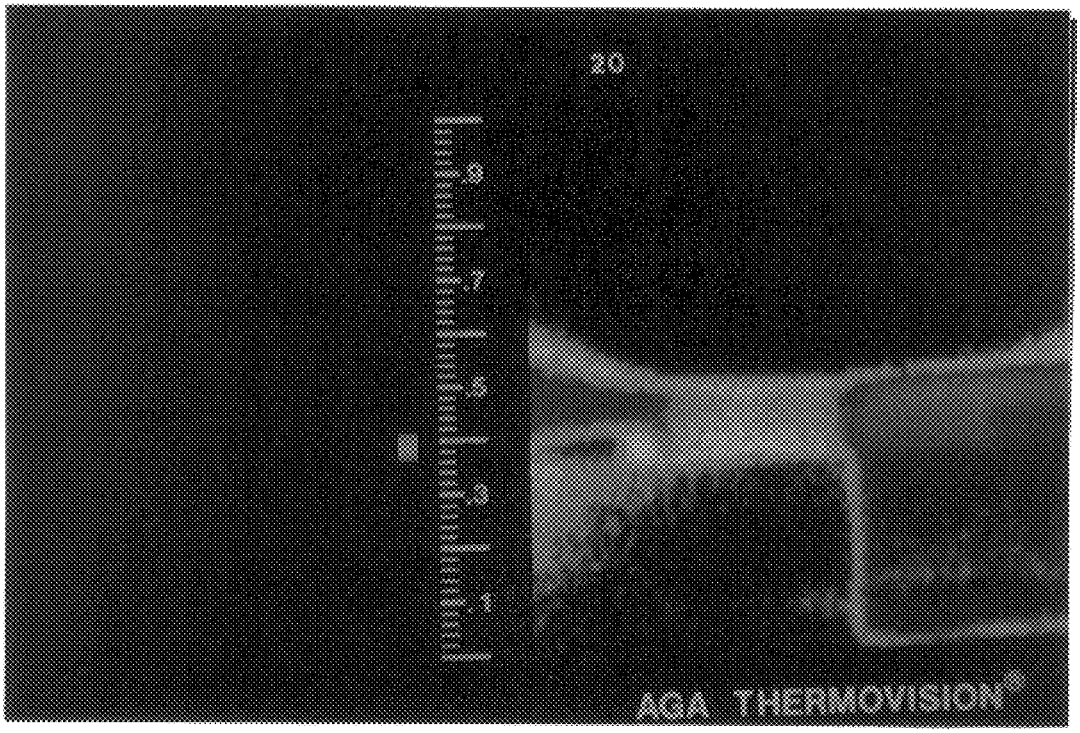
FIGS. 17 and 18 are first and second thermographic images of the test installation seen at a camera setting of 20 unit.
Figure 18:
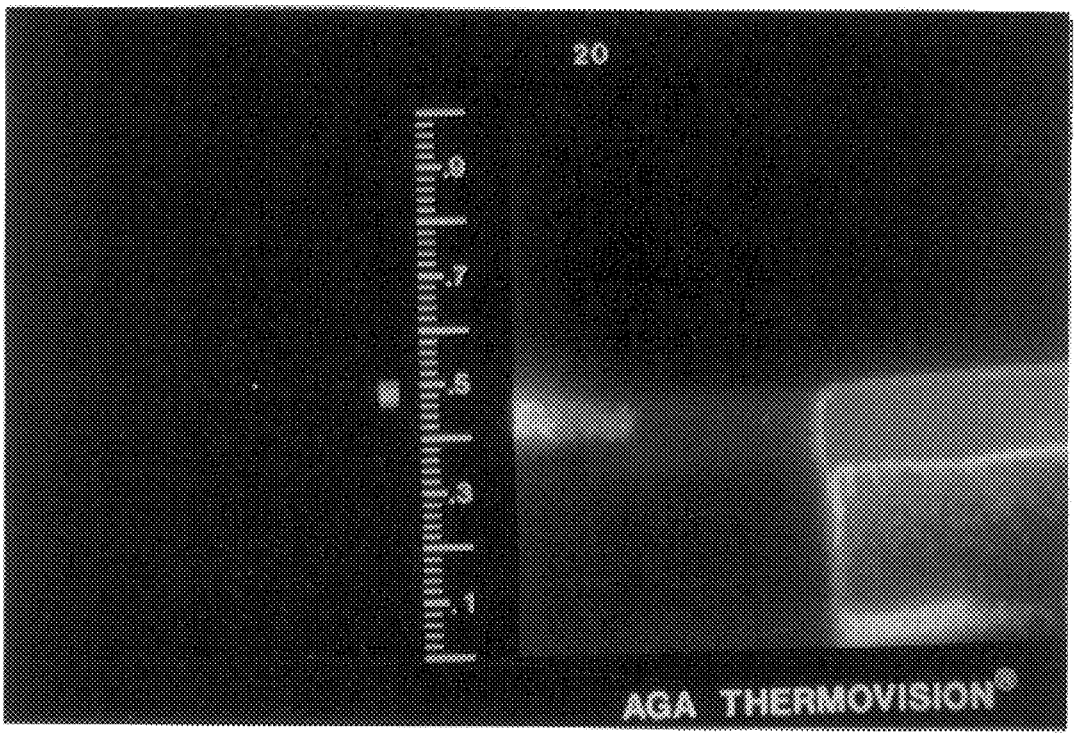

Referring now to FIGS. 17 and 18, similar images were taken at a temperature range of 20 unit. The left baseboard heater 90 had an isotherm reading of 0.4 and the right baseboard heater 92 had a reading of 0.5, indicating a temperature difference between the two heaters of 2.1° C.

These thermograms also indicate a substantial increase in efficiency in the baseboard heater 92 mounted over the heat recovery reflector 20. The heat reflected forwardly by the heat recovery reflector 20 becomes available to increase the heat of the housing of the heat convector 92, which additional heat is then available for transfer by convection to the air moving inside the housing of the heat convector 92.

Further tests were made to determine the actual energy saving attributable to the heat recovery reflector 20 according to the present invention. The electric baseboard heaters of an entire house were equipped with heat recovery reflectors 20 according to the preferred embodiment, and were operated during a nominal period of time. The energy costs during that period was compared to an equivalent previous period. Adjustments were made to account for the differences in degree days and energy cost variations for the two periods. The reflective surface 36 in each of the heat recovery reflectors 20 had a heat reflective index of about 87%. The findings were that, with the use of the heat recovery reflector according to the preferred embodiment, the average heating energy consumption was reduced by 21.8% and the average energy cost was reduced by 11.1%.

Although the preferred embodiment was described as a heat recovery reflector 20 mounted behind an electric baseboard heat convector 22, it will be appreciated that the same heat recovery reflector 20 may also be installed behind a hot water baseboard heater or other heaters to obtain substantially the same results as those mentioned herein.

Figure 19:
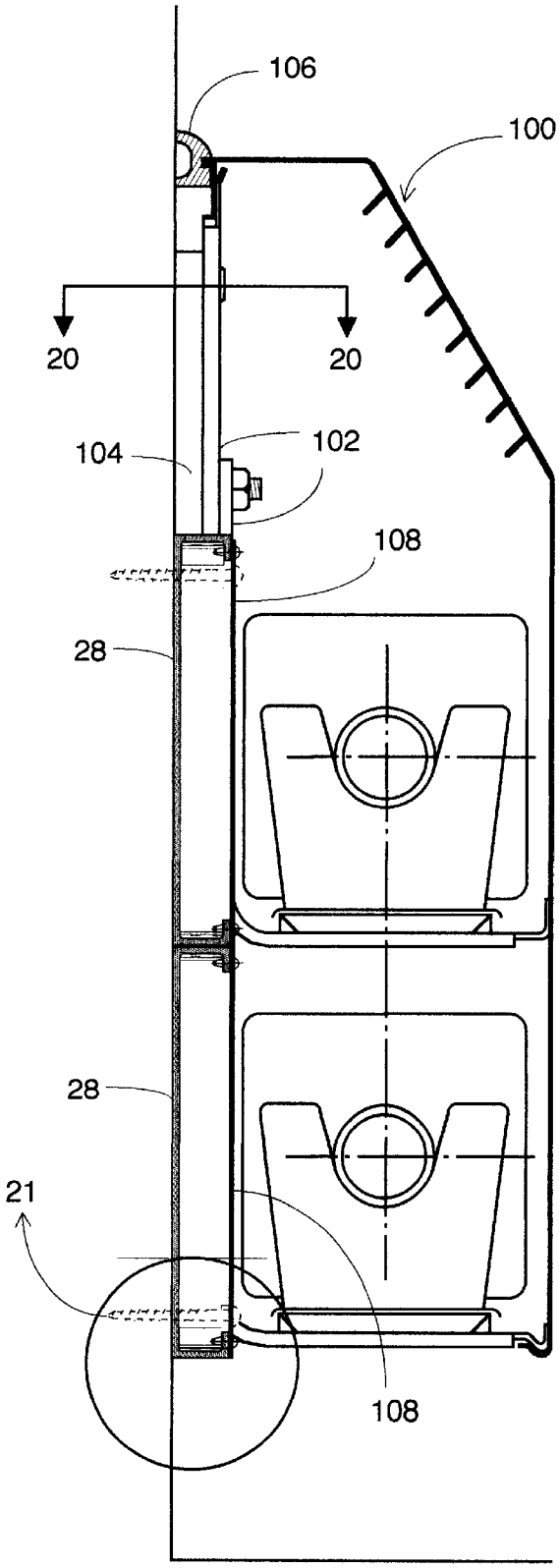
FIG. 19 is a cross-section view of a commercial wall-fin convector with two rows of heat recovery reflectors mounted there behind.
Figure 20:
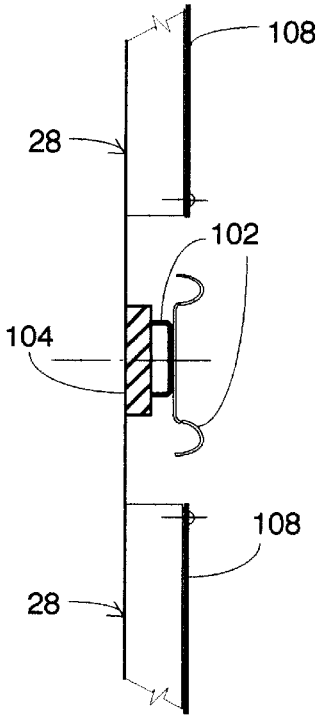
FIG. 20 is a cross-section view of a hanger supporting a commercial heat convector, as seen along line 20—20 in FIG. 19.

As one example of an alternate embodiment of the present invention, it will be appreciated that an array of heat recovery reflectors may be mounted behind a commercial wall-fm convector 100, as illustrated in FIG. 19, to obtain similar advantages as those described herein above. In the case of a large commercial wall-fin convector 100, it is recommended to mount two rows of heat recovery reflectors behind the convector. The two rows preferably extend between the hangers 102 of the convector 100, as illustrated in FIG. 20. It is also recommended to install a shim 104 behind each hanger 102, and an enlarged molding 106 to provide the space required for mounting the heat recovery reflectors behind the convector 100.

Figure 21:
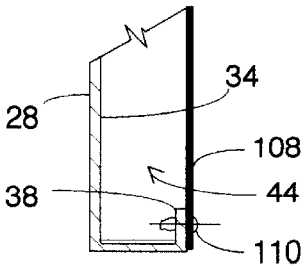
FIG. 21 illustrates an enlarged view of the attachment of the sheet metal cover to the lip of the flange of the heat recovery reflector, as seen in detail circle 21 in FIG. 19.

In an installation where the commercial wall-fin convectors 100 do not have a back wall, it is recommended to mount a strip of sheet metal 108 to the lips 38 of each channel extrusion 28 of the heat recovery reflector, by means of pop rivets 110 through the lips 38 or otherwise. The strip of sheet metal 108 encloses the front side of the extrusion 28, to maintain the reflective surface 34 in an enclosed dust free space 44, as shown in FIG. 21.

Figure 22:
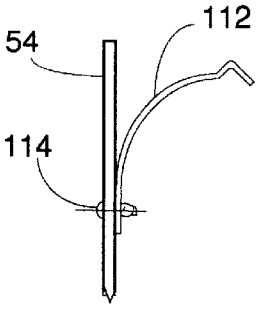
FIG. 22 illustrates an alternate clip for retaining an end cap to one of the flanges of the heat recovery reflector.

It will also be appreciated that the configuration of the heat recovery reflector according to the present invention is not limited to the structure illustrated in the preferred embodiment and may vary with the preferences of different manufacturers. It is known for example, that the end cap 52 may be retained to the flanges of the channel extrusion 28 by notched tabs other than the plastic tabs 56 mentioned before. A steel clip 112, for example, as illustrated in FIG. 22, may be used and fastened to the flat strip 54 of the end cap by pop rivets 114.

Therefore it will be appreciated by those skilled in the art that various modifications, alternate constructions and equivalents may be employed without departing from the true spirit and scope of this invention. Therefore, the above description and the illustrations should not be construed as limiting the scope of the invention, which is defined by the appended claims.

What is claimed is:

1. A heat recovery reflector for installation behind a baseboard heat convector for reflecting heat radiated from a back surface of said baseboard heat convector, said heat recovery reflector comprising:

a channel-like extrusion having a length, a web, a heat reflective surface on said web and flanges bordering said web and said heat reflective surface, said flanges having a substantial depth relative to said web and dust seal means there along, away from said web;

such that said channel-like extrusion is mountable behind a baseboard heat convector with said dust seal means in contact with a back surface of said baseboard heat convector for defining with said back surface a dust free space enclosing said reflective surface.

2. A heating installation comprising, a wall, a baseboard heat convector affixed to said wall and a heat recovery reflector mounted between said baseboard heat convector and said wall, for reflecting heat radiated from said baseboard heat convector toward said wall, said baseboard heat convector having a back surface and said heat recovery reflector comprising:

a channel-like extrusion having a length, a web, a heat reflective surface on said web and flanges bordering said web and said heat reflective surface. said flanges having a substantial depth relative to said web, and dust seal means there along in a sealed contact against said back surface;

such that said channel-like extrusion defines with said back surface a closed space for maintaining heat reflective surface is maintained in a dust free environment.

3. The heating installation as claimed in claim 2, wherein said depth is about ¾ on an inch.

4. The heating installation as claimed in claim 2, wherein a height and length of said heat recovery reflector are similar to a height and length of said baseboard heat convector.

5. The heating installation as claimed in claim 2, wherein said dust seal means comprises a lip along an edge of said flange.

6. The heating installation as claimed in claim 5, wherein said lips define a plane which is contiguous with said back surface of said heat convector.

7. The heating installation as claimed in claim 6, wherein each of said lips has a height of about ⅜ of an inch.

8. The heating installation as claimed in claim 2, wherein each of said flanges has an outside surface relative to said web and said outside surface is a paintable surface.

9. The heating installation as claimed in claim 2, wherein each of said flanges has an inside surface relative to said web, and said inside surface has serrations thereon.

10. The heating installation as claimed in claim 9, wherein said channel-like extrusion has ends and said heat recovery reflector further comprises caps covering said ends.

11. The heating installation as claimed in claim 10, wherein each of said caps has tabs extending therefrom toward an inside region of said channel-like extrusion, and each of said tabs has a notch thereon and said notch is engaged with one of said serrations on one of said flanges.

12. The heating installation as claimed in claim 11, wherein each of said cap has an outside surface and said outside surface is a paintable surface.

13. The heating installation as claimed in claim 12, wherein said outside surface has rounded edges.

14. The heating installation as claimed in claim 9, further comprising a stiffening blade held in said serrations in said channel-like extrusion, and extending transversely between said flanges.

15. The heating installation as claimed in claim 11, wherein each of said tab is flexible.

16. The heating installation as claimed in claim 2, wherein said heat reflective surface has a heat reflection index of between about 85% and about 95%.

17. The heating installation as claimed in claim 2, wherein said channel-like extrusion is made of a plastic material.

18. A reflector kit for installation behind a baseboard heat convector for recovering heat radiated from a back surface of said baseboard heat convector, said reflector kit comprising:

a channel-like extrusion having a length, a web having a heat reflective surface thereon, flanges extending from and bordering said web and said heat reflective surface, and two ends defining said length;

each of said flanges has an inside surface relative to said web, and said inside surface has serrations thereon, and a pair of caps for covering said ends, said caps having tabs extending therefrom and each of said tabs having a notch thereon and said notch being engagedly mountable in one of said serrations on one of said flanges, such that said channel-like extrusion is cuttable for varying said length and said caps are nonetheless mountable to said ends.

19. The reflector kit as claimed in claim 18, wherein each of said caps has an outside surface and said outside surface is a paintable surface with rounded corners.

20. The reflector kit as claimed in claim 18, wherein said channel-like extrusion has a hole there through near one of said ends, and a V-shaped notch extending between said hole and said end.

* * * * *